US007267426B2

(12) United States Patent
Miyajima et al.

(10) Patent No.: US 7,267,426 B2
(45) Date of Patent: Sep. 11, 2007

(54) LIQUID-REPELLENT FILM-COATED MEMBER, CONSTITUTIVE MEMBER OF LIQUID-JET DEVICE, NOZZLE PLATE OF LIQUID-JET HEAD, LIQUID-JET HEAD, AND LIQUID-JET DEVICE

(75) Inventors: Hiroo Miyajima, Nagano (JP); Shintaro Asuke, Nagano (JP); Yasuhide Matsuo, Nagano (JP); Sukenori Ichikawa, Nagano (JP); Yasunori Koike, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 235 days.

(21) Appl. No.: 10/835,420

(22) Filed: Apr. 30, 2004

(65) Prior Publication Data

US 2005/0001879 A1 Jan. 6, 2005

(30) Foreign Application Priority Data

May 7, 2003 (JP) ..... P.2003-129261
May 7, 2003 (JP) ..... P.2003-129263
Mar. 31, 2004 (JP) ..... P.2004-102925

(51) Int. Cl.
*B41J 2/135* (2006.01)
*B05D 7/00* (2006.01)

(52) U.S. Cl. ..... 347/45; 427/419.2; 427/419.3; 427/419.8

(58) Field of Classification Search ..... 347/45, 347/47; 427/403, 407, 412.1–413, 419.2–419.5, 427/419.8, 316, 318, 488, 489, 491, 533, 427/536–537, 540, 558, 559, 376.1–376.8, 427/384–397.8, 430.1, 435
See application file for complete search history.

(56) References Cited

U.S. PATENT DOCUMENTS 5,268,198 A 12/1993 Yamasaki et al.
5,646,657 A 7/1997 Aoki
6,106,689 A * 8/2000 Matsuyama ..... 205/333
6,207,236 B1 * 3/2001 Araki et al. ..... 427/386
6,291,022 B1 9/2001 Hong et al.
6,481,825 B1 * 11/2002 Hinami et al. ..... 347/29
2003/0030696 A1 2/2003 Sato et al.

FOREIGN PATENT DOCUMENTS

EP 0 476 510 A1 3/1992
JP 5-116309 A 5/1993
JP 5-116324 A 5/1993
JP 6-346046 A 12/1994
JP 2000-351938 A 12/2000

OTHER PUBLICATIONS

Patent Abstracts of Japan (1985)—60 178065A, vol. 0100 No. 18.
XP-002292131—(1989) Derwent Publications Ltd., London, GB.
European Search Report dated Aug. 23, 2004.

* cited by examiner

*Primary Examiner*—Lamson Nguyen
*Assistant Examiner*—Lisa M. Solomon
(74) *Attorney, Agent, or Firm*—Sughrue Mion, PLLC

(57) ABSTRACT

The present invention provides a member comprising a substrate, an undercoat film formed on a surface of the substrate, and a liquid-repellent film of metal alkoxide formed on a surface of the undercoat film. Also disclosed are nozzle head, liquid-jet head and liquid-jet device employing the above-described member.

18 Claims, 4 Drawing Sheets

LIQUID-REPELLENT FILM-COATED MEMBER, CONSTITUTIVE MEMBER OF LIQUID-JET DEVICE, NOZZLE PLATE OF LIQUID-JET HEAD, LIQUID-JET HEAD, AND LIQUID-JET DEVICE

FIELD OF THE INVENTION

The present invention relates to a liquid-repellent film-coated member, a constitutive member of liquid-jet devices, a nozzle plate of liquid-jet heads, a liquid-jet head, and a liquid-jet device. In particular, the invention relates to a liquid-jet device that has an undercoat film and a liquid-repellent film of a metal alkoxide molecular film formed not only on the surface of the nozzle plate substrate of the liquid-jet head thereof, but also on the surfaces of other constitutive members thereof (including members other than metal members, such as resinous members and composite material members).

BACKGROUND OF THE INVENTION

An inkjet printer head, one embodiment of liquid-jet head through which liquid droplets are jetted out toward media via the nozzle orifices thereof, has a nozzle plate, and a plurality of fine inkjet orifices through which ink is jetted out are formed in the nozzle plate at fine intervals. If ink adheres to the surface of the nozzle plate, then other ink that is jetted out later may be influenced by the surface tension and the viscosity of the previously-adhering ink to have a curved jetting trajectory. This arises a problem that the ink could not be applied to a predetermined site. Accordingly, the nozzle plate surface has to be subjected to liquid-repelling treatment for protecting it from ink adhesion.

Some methods mentioned below are known as the technique of liquid-repelling treatment. One of the methods is as follows: A nozzle plate at room temperature is dipped in a solution of a liquid-repellent silane coupling agent such as an alkoxysilane solution for tens seconds. In this stage, the temperature of the alkoxysilane is at around room temperature. Next, the dipped nozzle plate is pulled up out of the solution at a rate of about few mm/sec, thus forming a monomolecular film of an alkoxysilane polymer on its surface. The nozzle plate is then dried for one full day at room temperature to vaporize the solvent, thereby obtaining a water-repellent monomolecular film on the metal surface of the nozzle plate through dehydrating polycondensation.

As another example of the methods, a method described in Patent Document 1 can be cited. This method comprises dipping an absorbent in a mixture of a fluorine-containing polymer compound and a compound having a fluorine-substituted hydrocarbon group and a silazane, alkoxysilane or halogenosilane group, then pulling it up out of the solution, and moving the absorbent while pressed against a nozzle plate to effect coating on the nozzle plate. After thus coated, the nozzle plate is thermally dried and cured at 150° C. for 1 hour to thereby form a liquid-repellent film thereon.

As a still other example of the methods, a method described in Patent Document 2 can be cited. This method comprises masking a nozzle plate, at a part thereof not requiring liquid-repellency, with an aluminium mask, and dipping it in a solution mixed with a substance having a plurality of trichlorosilyl groups, for about 30 minutes to thereby form a chlorosilane monomolecular film thereon. Then, the chlorosilane monomolecular film is washed with chloroform and then with water so that it is reacted to form a siloxane monomolecular film. The siloxane monomolecular film is dipped in a solution of a substance having a fluorocarbon group and a chlorosilane group for about 1 hour, whereby a fluorine-containing monomolecular film is formed on the surface of the nozzle head and the thin aluminium film thereon. Next, the thin aluminium film is etched away, and thus a liquid-repellent monomolecular film is formed on the surface of the nozzle head.

Patent Document 1: JP-A 5-116309

Patent Document 2: JP-A 5-116324

The alkoxysilane molecular film reacts with the OH group that terminates the nozzle plate surface and bonds to the nozzle plate. Accordingly, if a large number of OH groups exist on the nozzle plate surface, then alkoxysilane molecules corresponding to the existing OH groups bond to the nozzle plate. In other words, if a larger number of OH groups exist thereon, then the resulting molecular film has a higher density and, as a result, the liquid-repellency of the resulting nozzle plate is higher. However, since the number of OH groups existing on the surface of metal such as stainless steel is smaller than that on the surface of glass or the like, the obtained molecular film formed through polymerization of a silane coupling material on the surface of metal merely had a low density and poor adhesion. Accordingly, there was a problem that the water-repellency of the molecular film is low and that the film could not ensure its water-repellency for a long period of time.

Ink heretofore used in the background art was generally dye-based ink, and its solvent was water. Therefore, a water-repellent molecular film could repel such dye-based ink so long as it has water repellency. Recently, however, pigment-based ink has become used to cope with high-quality prints from digital still cameras, etc. For the solvent for such pigment-based ink, a resin-based dispersant is used. Therefore, molecular films for printer members for such pigment-based ink are required to have both water repellency and oil repellency (hereinafter collectively referred to as "liquid repellency"). However, the molecular films disclosed in Patent Documents 1 and 2 do not have both water repellency and oil repellency, and hence involve a problem that the molecular films are wetted.

Heretofore, the members of liquid-jet devices other than nozzle plates were not treated for ink repellency. The absence of ink-repellency treatment arises the following problem. Ink adheres to no small extent to the members such as cap and wiper that directly contact with ink, and if the members are formed of wettable material, then the ink having adhered thereto may stay thereon as such. When the adhered ink is left as it is, it may thicken to cause staining and operation failure of the members. Especially with respect to wiper members, ink is led through or to various members, such as from wiper body (rubber, elastomer, urethane) to wiper-holding lever (polyoxymethylene (POM)), then to system body (acrylonitrile-butadiene-styrene (ABS)) and to waste absorbent, and is absorbed by these members. Therefore, there is a probability that ink may be hardly led through or to these members. In addition, thickened ink may adhere to a lower part of a carriage on which a head is to be mounted, and it may be transferred onto the head upon operation of the wiper.

SUMMARY OF THE INVENTION

The present invention has been made for solving the above-mentioned problems.

Accordingly, an object of the invention is to provide a member having a liquid-repellent film of a metal alkoxide in which the adhesion of the metal alkoxide liquid-repellent film to the surface of the substrate such as nozzle plate is high and the density of the liquid-repellent film is high.

Another object of the invention is to provide a constitutive member comprising the above-mentioned member.

A still other object of the invention is to provide a nozzle plate comprising the member, and to provide a liquid-jet head and a liquid-jet device that comprise the nozzle plate.

Other objects and effects of the invention will become apparent from the following description.

To attain the above-mentioned objects, the invention is to use liquid-repellent film-coated members not only for nozzle plate (formed of metal) of liquid-jet head in liquid-jet devices but also for any other system-constituting members (formed of resin material, composite material) of liquid-jet devices. In the invention, the liquid-repellent film-coated member is constructed by treating the surface of the undercoat film formed on the surface of a substrate for OH formation, and then forming thereon a liquid-repellent film of a metal alkoxide molecular film, preferably, employing a metal alkoxide having a fluorine-containing long-chain polymer group as the metal alkoxide. Thereby, the invention has made it possible to prevent staining of system members and to prevent operation failure thereof, and has succeeded in solving the above-mentioned problems.

Specifically, the above-mentioned objects of the invention have been achieved by providing the following members, nozzle plate, liquid-jet head, and liquid-jet devices.

(1) A member comprising a substrate, an undercoat film formed on a surface of the substrate, and a liquid-repellent film of metal alkoxide formed on a surface of the undercoat film.

(2) The member according to item (1) above, wherein the liquid-repellent film is a molecular film of a polymer of metal alkoxide.

(3) The member according to item (1) above, wherein the metal alkoxide has a fluorine-containing long-chain polymer group.

(4) The member according to item (1) above, wherein the metal alkoxide is a metal acid salt having a liquid-repellent group.

(5) The member of according to item (1) above, wherein the metal alkoxide is a silane coupling agent.

(6) The member according to item (1) above, wherein the undercoat film comprises a plasma polymerization film of a silicone material, or contains $SiO_2$, ZnO, NiO, $SnO_2$, $Al_2O_3$, $ZrO_2$, copper oxide, silver oxide, chromium oxide or iron oxide.

(7) The member according to item (1) or (2) above, wherein the liquid-repellent film is formed by a process comprising:

terminating the surface of the undercoat film with OH group through oxidation and hydrogenation; and reacting a metal alkoxide with the OH group at the surface of the undercoat film.

(8) The member according to item (1) or (2) above, wherein the liquid-repellent film is formed by a process comprising:

terminating the surface of the undercoat film with OH group through irradiation with plasma or UV rays; and reacting a metal alkoxide with the OH group at the surface of the undercoat film.

(9) The member according to item (1) above, wherein the substrate comprises a metal material or a composite material.

(10) The member according to item (1) above, wherein the substrate comprises a resinous material.

(11) The member according to item (9) above, wherein the metal material is stainless steel.

(12) The member according to item (9) above, wherein the composite material contains silicon, sapphire or carbon.

(13) The member according to item (10) above, wherein the resinous material comprises at least one compound selected from the group consisting of polytetrafluoroethylene, polyethylene, polyimide, polyamidimide, polyphenylene sulfide, polyether-ether ketone, polyoxymethylene, polystyrene, acrylonitrile-butadiene-styrene, polybutylene terephthalate, polyphenylene ether, potassium titanate fiber-composite resin, polypropylene, ethylene-propylene-diene tercopolymer, olefin elastomer, urethane elastomer, chloroprene rubber, silicone rubber and butyl rubber.

(14) The member according to item (1) above, wherein the substrate is resistant to heat at least at 400° C., and the liquid-repellent film is formed on the undercoat film by a process comprising:

heating the undercoat film; and dipping the undercoat film in a metal alkoxide solution while heated.

(15) The member according to item (14) above, wherein the heating temperature of the undercoat film falls between 200 and 400° C.

(16) A nozzle plate for a liquid-jet head, which comprises the member according to any of items (1) to (14) above.

(17) A liquid-jet head comprising the nozzle plate according to item (16) above.

(18) A liquid-jet device equipped with the liquid-jet head according to item (17) above.

(19) The member according to any of items (1) to (8), (10) and (13) above, which is a head cap, a head cleaning wiper, a head cleaning wiper-holding lever, a gear, a platen, or a carriage.

(20) A liquid-jet device equipped with the member according to item (19) above.

As so described hereinabove, the invention is to use liquid-repellent film-coated members not only for nozzle plate (mainly formed of metal) of liquid-jet head in liquid-jet devices but also for any other system-constituting members (including those formed of resin material or composite material) such as head cap, head cleaning wiper, head cleaning wiper-holding lever, gear, platen or carriage of liquid-jet devices. Applying the ink-repellent treatment to parts of system units solves the following troubles (i) to (iii) with liquid-jet devices.

(i) When the parts that frequently contact with ink, such as head cap, head cleaning wiper, head cleaning wiper-holding lever, etc. are processed for ink repellency, then the parts themselves can be protected from ink adhesion thereto. Specifically, it is as follows:

Head cap receives few cap marks (adhesion of thickened ink) from the face of nozzle plate (NP).

Wiping performance of the head cleaning wiper lasts long as ink adhesion thereto reduces.

Head cleaning wiper-holding lever readily lead waste ink from wiper to waste absorbent.

Gear operation failure caused by ink wrapping around thereof is reduced.

Thickened ink transfer to head caused by thickened ink adhesion to carriage is prevented.

(ii) The parts themselves (especially those for driving operation, such as gear) are protected from ink adhesion thereto, and are therefore prevented from operation failure owing to thickened ink adhesion thereto.

(iii) The system-constituting members may be processed for ink repellency irrespective of the contact angle of their materials (mainly engineering plastic resins such as polyphenylene sulfide (PPS), polyoxymethylene (POM), acrylonitrile-butadiene-styrene (ABS), elastomer, rubber), and therefore recovery of waste ink is easy. In other words, ink having adhered to head cap and wiper can be readily led to waste absorbent.

In the liquid-repellent film-coated member of the invention, an undercoat film is formed on the surface of the substrate as described above. The material for the substrate is not specifically limited, and may be any of metal material, composite material and resinous material. More effectively, the surface roughness (Ra) of the substrate is 65 nm or less, preferably 35 nm or less.

The undercoat film may be suitably selected and used depending on the substrate. For example, it may comprise a plasma polymerization film of a silicone material, or may contain $SiO_2$, ZnO, NiO, $SnO_2$, $Al_2O_3$, $ZrO_2$, copper oxide, silver oxide, chromium oxide or iron oxide. The surface of the undercoat film is oxidized and hydrogenated, specifically, it is irradiated with plasma or UV rays and then exposed to air whereby the surface may be terminated with OH group (i.e., the surface is hydroxylated). Then, when a liquid-repellent film of metal alkoxide is formed on the thus-processed undercoat film, the OH groups on the undercoat film bond to the liquid-repellent film of metal alkoxide. As a result, a liquid-repellent film of metal alkoxide having high density and high adhesion can be formed.

In the case where the substrate is resistant to heat at least at 400° C., the undercoat film may be dipped in a metal alkoxide solution while heated, so as to form a liquid-repellent film of metal alkoxide on the undercoat film. In this embodiment, a molecular film of alkoxysilane polymer having a uniform thickness may be formed on the surface of the undercoat film.

In the molecular film thus formed, the metal atom derived from the metal alkoxide bonds to the undercoat film via the oxygen atom. When the metal alkoxide used in the invention has a fluorine-containing long-chain polymer group, then the fluorine-containing long-chain polymer group that bonds to the metal atom derived from the metal alkoxide exists on the surface side of the film. Referring to the condition of the molecular film in this stage, the metal atoms bond three-dimensionally and the fluorine-containing long-chain polymer groups are complicatedly entangled with each other. Accordingly, the molecular film is in a dense condition, and ink hardly penetrates thereinto.

As a result, the liquid-repellent film-coated member of the invention ensures excellent liquid repellency and keep it for a long period of time. In addition, because of its high density, the liquid-repellent film has excellent abrasion resistance.

A summary of a process for producing the liquid-repellent film-coated member of the invention is described below.

The liquid-repellent film-coated member of the invention is produced according to a process comprising at least (1) substrate washing, (2) undercoat film formation, (3) surface activation of undercoat film, (4) liquid-repellent metal alkoxide film formation, (5) wetting and drying treatment, and (6) annealing.

The step (1) "substrate washing" is for removing unnecessary matters that are inconvenient for undercoat film formation, from the substrate. Details of the washing condition shall be suitably determined depending on the material, form and size of the substrate.

Details of the film-forming condition in the step (2) "undercoat film formation" shall be suitably determined depending on the material, form and size of the substrate and on the type and thickness of the undercoat film to be formed.

The step (3) "surface activation of undercoat film" is for imparting OH groups to the surface of the undercoat film in order that the liquid-repellent film of metal alkoxide to be formed thereon is more firmly bonded thereto. Specifically, examples of this step include irradiation of the undercoat film surface with plasma or UV rays. Details of the treatment condition shall be suitably determined depending on the type and thickness of the undercoat film and on the type of the metal alkoxide for the liquid-repellent film to be formed.

Details of the film-forming condition in the step (4) "liquid-repellent metal alkoxide film formation" shall be suitably determined depending on the type of the metal alkoxide and on the intended liquid repellency of the film.

In the step (5) "wetting and drying treatment", the coated substrate is put in a high-temperature high-humidity atmosphere for polymerization of the metal alkoxide to give a molecular film thereof. Details of the treatment condition shall be suitably determined depending on the type of the metal alkoxide and on the intended liquid repellency of the film.

In the step (6) "annealing", the coated substrate is treated at a temperature higher than the temperature in the previous step (5) "wetting and drying treatment", and this is for terminating the polymerization reaction of the metal alkoxide. Details of the treatment condition shall be suitably determined depending on the type of the metal alkoxide and on the intended liquid repellency of the film.

The liquid-jet head of the invention has a feature that it comprises the nozzle plate mentioned above.

The liquid-jet device of the invention has a feature that it comprises the above-mentioned liquid-jet head, or comprises a head cap, a head cleaning wiper, a head cleaning wiper-holding lever, a gear, a platen and/or a carriage, each of which has the liquid-repellent film-coated member of the invention.

Figure 1:
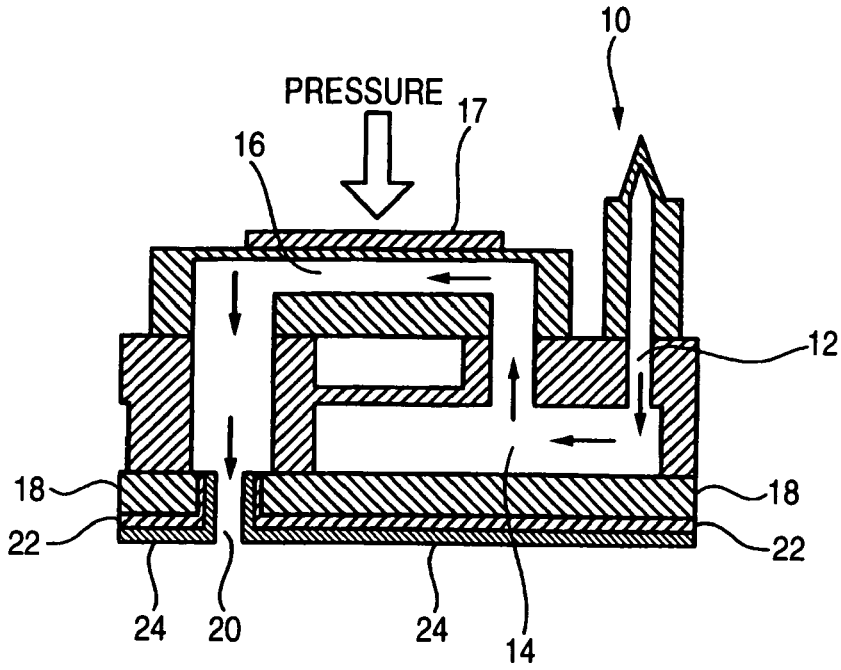
FIG. 1 is an explanatory view of a cross section of an inkjet printer according to one embodiment of the invention.

The reference numerals used in the drawings denote the followings, respectively.

10: Inkjet printer head
12: Ink guide
14: Ink reservoir
16: Pressure room
18: Nozzle plate
20: Inkjet orifice
22: Plasma polymerization film
24: Molecular film
24*a*: Silicon atom
24*b*: Fluorine-containing long-chain polymer group
26: Ink
30: Film-forming device
32: Chamber
34: Pump

36: Electrode
38: High-frequency power source
40: Stage
42: Gas-feed line
44: Material-feed line
46: Argon gas source
50: Material container
52: Heater
54: Liquid material

DETAILED DESCRIPTION OF PREFERRED EMBODIMENT

The liquid-repellent film-coated member, the constitutive member of liquid-jet devices, the nozzle plate of liquid-jet heads, the liquid-jet head and the liquid-jet device of the invention are described in more detail below with reference to preferred embodiments of the present invention.

The method of undercoat film formation and metal alkoxide film formation described below is one embodiment of the invention, in which a nozzle plate of a liquid-jet head, serving as a substrate and being formed of stainless steel, is to be coated with a liquid-repellent film. However, the invention is not limited thereto.

FIG. 1 shows a cross-sectional view of an ink-jet printer head 10 using ink droplets as the liquid droplets to be jetted out through the nozzle orifices, which is one example of the liquid-jet head (one member of a liquid-jet device). The inkjet printer head 10 has an ink guide 12 via which ink is led inside the head. The ink guide 12 is connected to an ink reservoir 14, and is so designed that ink may be stored in the ink reservoir 14. The ink reservoir 14 communicates with a pressure room 16, and on the inkjet side thereof, the pressure room 16 is connected to an inkjet orifice 20 formed in the nozzle plate 18.

The pressure room 16 is so designed that pressure may be applied to a part of its wall. This structure is arranged, for example, by forming a part of the wall of the pressure room 16 with a diaphragm, and providing an exciting electrode 17 (piezoelectric element) on its outside surface. When a voltage is applied to the exciting electrode 17, then the diaphragm is vibrated owing to the resulting electrostatic force and the inner pressure in the pressure room is thereby changed. By the inner pressure, ink is jetted out through the inkjet orifice 20.

As the nozzle plate 18, one formed of stainless steel (in this embodiment, SUS316) is used. The surface of the nozzle plate 18 and the inner surface of the ink-jet orifice 20 are coated with a plasma polymerization film 22 that is formed through plasma polymerization of a silicone material. The surface of the plasma polymerization film 22 is coated with a liquid-repellent molecular film 24 of metal alkoxide.

The metal alkoxide molecular film 24 may be any so long as it is repellent to water and oil, but is preferably a monomolecular film of a metal alkoxide having a fluorine-containing long-chain polymer group (hereinafter referred to as "long-chain RF group") or a monomolecular film of a metal acid salt having a liquid-repellent group.

The metal alkoxide include those containing, for example, any of Ti, Li, Si, Na, K, Mg, Ca, St, Ba, Al, In, Ge, Bi, Fe, Cu, Y, Zr or Ta, but those containing silicon, titanium, aluminium or zirconium are generally used. In this embodiment, the metal alkoxide containing silicon is used. Preferably, it is a fluorine-containing long-chain RF group-having alkoxysilane, or a liquid-repellent group-having metal acid salt.

The long-chain RF group has a molecular weight of at least 1000, and examples thereof include, for example, a perfluoroalkyl chain and a perfluoro-polyether chain.

One example of the long-chain RF group-having alkoxysilane is a long-chain RF group-having silane coupling agent.

Suitable examples of the long-chain RF group-having silane coupling agent for the liquid-repellent film in the invention include, for example, heptatriacontafluoroeicosyltrimethoxysilane. Its commercial products include, for example, Optool DSX (trade name by Daikin Kogyo) and KY-130 (trade name by Shin-etsu Kagaku Kogyo).

The surface free energy of fluorocarbon group (RF group) is smaller than that of alkyl group. Therefore, when metal alkoxide has RF group, then the resulting liquid-repellent film have improved liquid repellency and, in addition, other properties such as chemical resistance, weather resistance and abrasion resistance are also improved.

As the long-chain structure of the RF group is longer, the liquid repellency of the film can be maintained for a longer period of time.

The liquid-repellent group-having metal acid salt includes, for example, aluminates and titanates.

Figure 5:
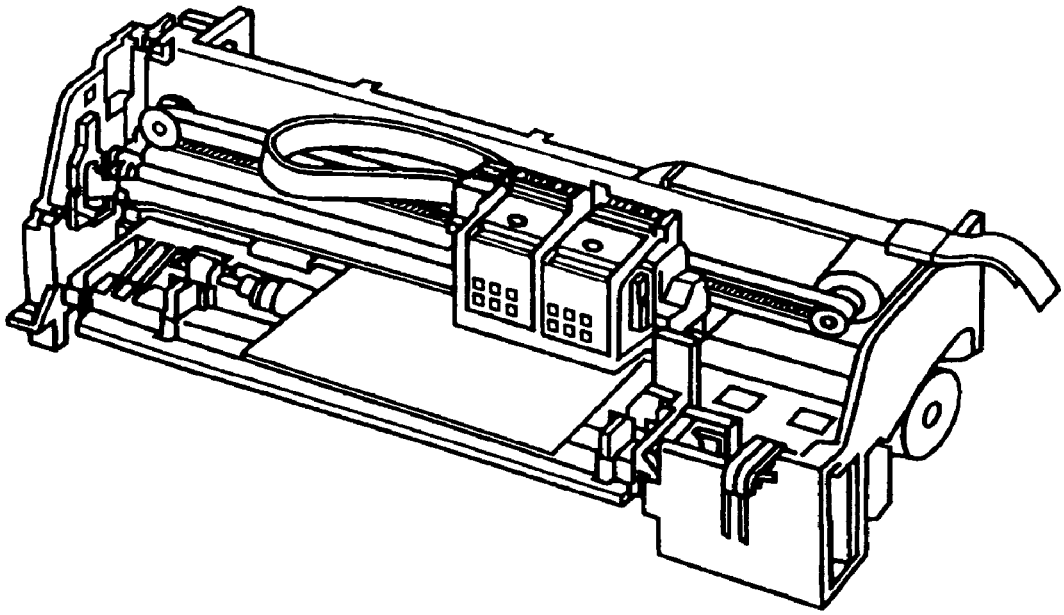
FIG. 5 is a perspective view of an inkjet printer according to one embodiment of the invention.

Using the thus-designed inkjet printer head 10, an inkjet printer is constructed as shown in FIG. 5.

Figure 2:
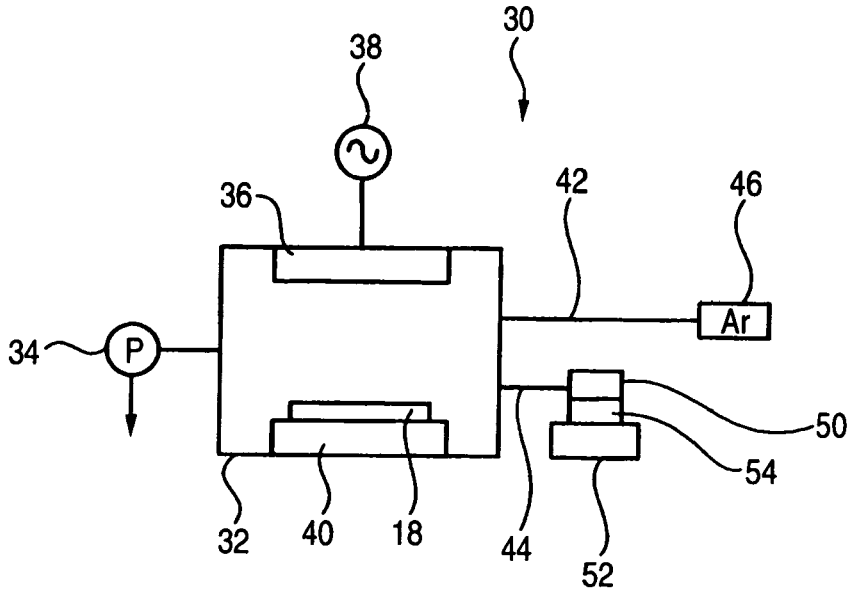
FIG. 2 is an explanatory view of a film-forming device for plasma polymerization film according to one embodiment of the invention.

Next described is a device for forming the plasma polymerization film 22 of a silicone material on the surface of nozzle plate 18 serving as the substrate. FIG. 2 shows an explanatory view of a device for forming the plasma polymerization film 22. The film-forming device 30 has a chamber 32, and a pump 34 is connected to the chamber 32. An electrode 36 is disposed on the top wall of the chamber 32, and a high-frequency power source 38 is connected to the electrode 36. The high-frequency power source 38 generates an electric power of, for example, about 300 W. A temperature-controllable stage 40, on which the nozzle plate 18 is mounted, is disposed on the bottom wall of the chamber 32 to be opposite to the electrode 36.

A gas-feed line 42 and a material-feed line 44 are connected to the chamber 32. An argon gas source 46 is connected to the gas-feed line 42 via a flow control valve (not shown). The flow control valve controls the flow rate of the gas to be fed into the chamber 32. A material container 50 that contains a material for the plasma polymerization film 22 is connected to the material-feed line 44. A heater 52 is disposed below the material container 50, so that the liquid material 54 can be vaporized.

The material for the plasma polymerization film 22 includes silicone oil and alkoxysilane, and more specifically includes dimethylpolysiloxane. Its commercial products include, for example, TSF451 (by GE Toshiba Silicone) and SH200 (by Toray Dow-Corning Silicone).

Sucked by the negative pressure of the chamber 32, the vaporized material is fed into the chamber 32 via the material-feed line 44.

Next described are a method of forming the plasma polymerization film 22 of a silicone material on the surface of the nozzle plate 18, and a method for forming the metal alkoxide molecular film 24 on the surface of the plasma polymerization film 22. In this embodiment, silicone (dimethylpolysiloxane) is used as the material for the plasma polymerization film 22; and fluorine-containing long-chain polymer group-having alkoxysilane (heptatriacontafluoroeicosyltrimethoxysilane) is used as the metal alkoxide.

First, silicone is polymerized to form the plasma polymerization film 22 on the surface of the nozzle plate 18. The plasma polymerization film 22 is formed by the use of the film-forming device 30. First, the nozzle plate 18 is disposed on the stage 40 in the chamber 32. Next, the chamber 32 is degassed to a predetermined level via the pump 34. In this step, the temperature of the stage 40 is so controlled that the polymerization of the material on the nozzle plate 18 is promoted at the controlled temperature. For example, the stage 40 is kept at 25° C. or higher (in this embodiment, 40° C.). After the chamber 32 has been degassed to a predetermined level, argon gas is fed therein and the pressure in the chamber 0.32 is kept at a predetermined level, for example, at about 7 Pa. An electric power of, for example, about 100 W is applied thereto from the high-frequency power source 38 connected to the electrode 36, and argon plasma is thereby generated in the chamber 32. Heated by the heater 52, the silicone in the material container 50 vaporizes and, as mentioned above, this is sucked by the negative pressure in the chamber 32 and is fed into the chamber 32 via the material-feed line 44. Then, the weakly bonding part of the vaporized silicone is cut by the argon plasma and the silicone is polymerized to form the plasma polymerization film 22 on the surface of the nozzle plate 18. The nozzle plate 18 has the inkjet orifice 20. The plasma polymerization film 22 is also formed on the inner surface of the inkjet orifice 20. The surface of the plasma polymerization film 22 is terminated by the methyl group that constitutes the silicone, and the methyl group bonds to the silicon atom of the silicone.

The plasma polymerization film 22 thus formed on the surface of the nozzle plate 18 is then annealed. For example, it is annealed in a nitrogen atmosphere at a temperature falling between 150° C. and 450° C. (in this embodiment, at 200° C.), whereby crosslinking of the plasma polymerization film 22 on the surface of the nozzle plate 18 is promoted. As a result, the hardness of the plasma polymerization film 22 increases, and the adhesion thereof to the nozzle plate also enhanced.

Next, the surface of the plasma polymerization film 22 is etched with plasma. Etching is carried out for oxidizing the surface. That is, the bonding between the methyl group that terminates the surface of the plasma polymerization film 22, and the silicon atom is cut, and an oxygen atom is bonded to the silicon atom. The plasma treatment is effected by exposing the surface of the plasma polymerization film 22 to plasma of argon, nitrogen or oxygen. In place of exposure to such plasma, the plasma polymerization film 22 may be irradiated with UV rays from excimer laser or deuterium lamp. For example, when argon plasma is used for the oxidation treatment, the surface of the plasma polymerization film 22 is exposed to argon plasma for about 1 minute. The oxidation treatment is followed by a subsequent treatment of bonding a hydrogen atom to the oxygen atom. Specifically, the plasma polymerization film 22 is exposed to air whereby a hydrogen atom is bonded to the oxygen atom that terminates the surface of the plasma polymerization film 22 (i.e., the oxygen atom is hydroxylated). After the treatment, the number of the OH groups on the surface of the plasma polymerization film 22 is much larger than that on the surface of the non-coated nozzle plate 18.

On the surface of the plasma polymerization film 22 thus formed on the nozzle plate 18, a water-repellent and oil-repellent metal alkoxide molecular film 24 is formed.

The metal alkoxide used in this embodiment is a long-chain RF group-having alkoxysilane. For the alkoxysilane, used herein is the above-mentioned heptatriacontafluoroeicosyltrimethoxysilane.

First, the alkoxysilane is mixed with a solvent such as thinner (in this embodiment, HFE-7200, trade name by Sumitomo 3M) to prepare a solution thereof having a concentration of, for example, 0.1% by weight.

Next, the nozzle plate 18 coated with the plasma polymerization film 22 is heated at 200 to 400° C., and then dipped in the above-mentioned solution. A molecular film of a polymer of the metal alkoxide can be readily formed on the metal surface within a short time after the metal is dipped in the metal alkoxide solution. Therefore, the time for forming the molecular film on the metal may be shortened. In addition, a thick and high-density molecular film can be formed. Accordingly, a molecular film having excellent abrasion resistance can be obtained.

Figure 3:
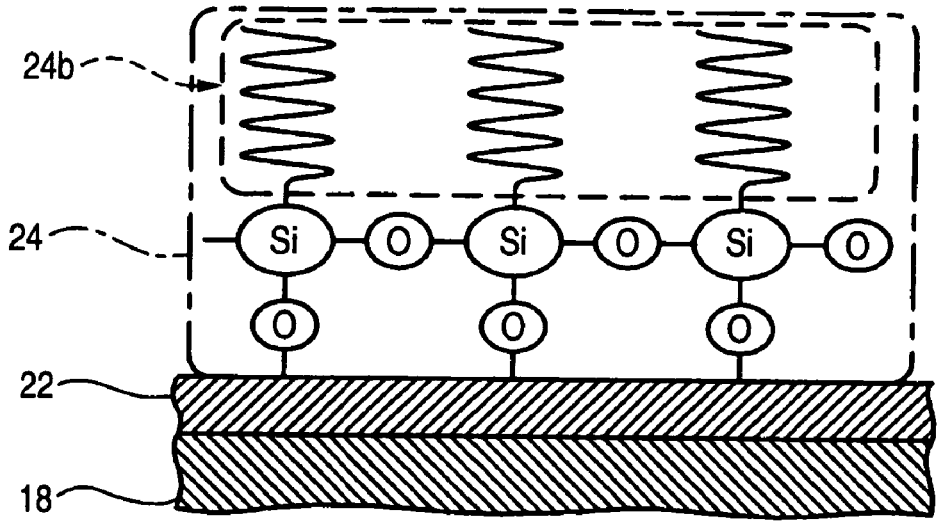
FIG. 3 is a schematic view showing the bonding in a molecular film according to one embodiment of the invention.
Figure 4:
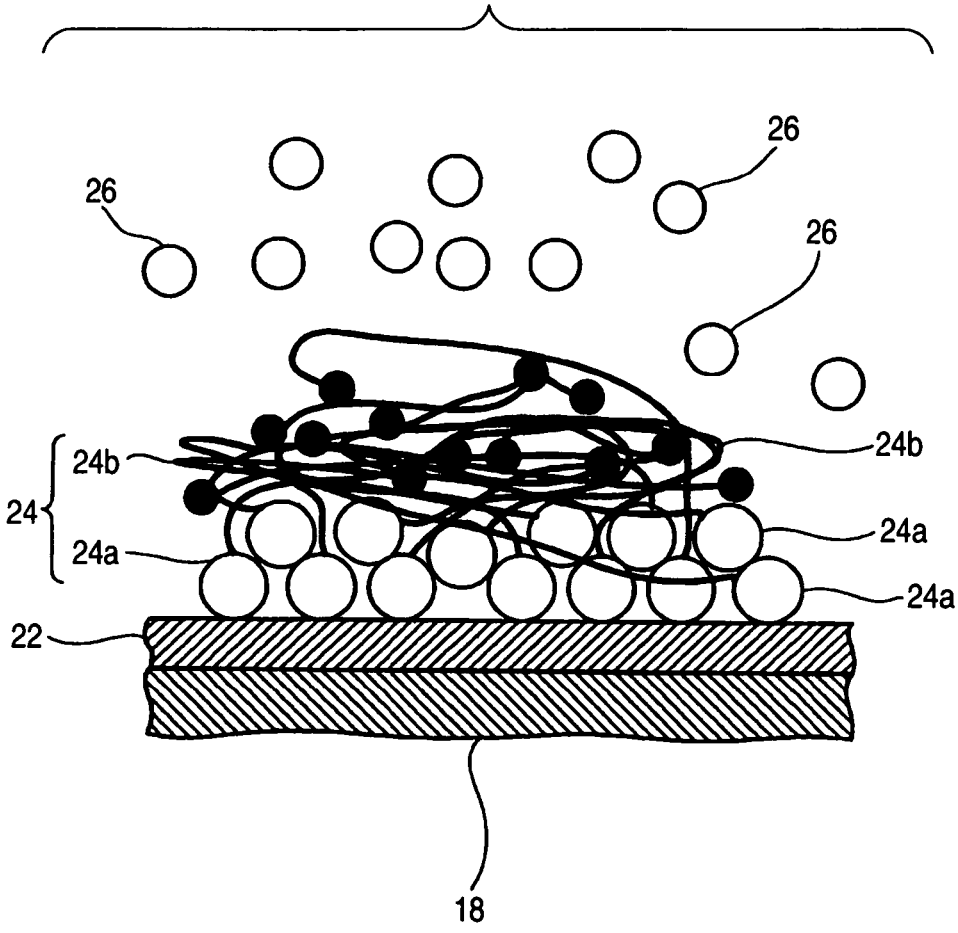
FIG. 4 is a schematic view showing the condition of a molecular film according to one embodiment of the invention.

For example, when the nozzle plate 18 is dipped at a temperature lower than 200° C., it is dipped therein for 0.5 seconds, and after having been thus dipped, the nozzle plate 18 is pulled up out of the solution at a rate of, for example, 2 mm/sec. FIG. 3 and FIG. 4 are schematic views of the molecular film 24 formed through polymerization of alkoxysilane on the surface of the plasma polymerization film 22 formed on the nozzle plate 18. FIG. 3 is a schematic view showing the bonding of the molecular film 24 to the plasma polymerization film 22. FIG. 4 is a schematic view showing the condition of the molecular film 24. When the nozzle plate 18 is dipped in the alkoxysilane solution, the molecular film 24 of a polymer of the alkoxysilane is formed on the surface of the plasma polymerization film 22 on the nozzle plate 18. The silicon atoms **24*a* of the molecular film 24 bond to the plasma polymerization film 22 via oxygen atom, and the fluorine-containing long-chain polymer groups 24*b* (hereinafter referred to as long-chain RF groups) bonding to the silicon atoms 24*a* are on the surface side of the film. In the molecular film 24 in this condition, the silicon atoms 24*a* bond three-dimensionally and the long-chain RF groups 24*b* are complicatedly entangled with each other. Accordingly, the molecular film 24 is in a dense condition, and ink 26 hardly penetrates into the molecular film 24**.

The molecular film 24 thus formed according to the above-mentioned method was tested for its surface abrasion resistance. In the abrasion resistance test, the surface of the molecular film 24 was rubbed with an absorbent that had been dipped in ink, by 1000-times rubbing operations. As a result, the surface of the molecular film 24 was not peeled, and even after repeatedly rubbed, the ink on the film surface was repelled within 5 seconds, showing no deterioration of the ink repellency of the film.

According to this embodiment as described above, the plasma polymerization film 22 of the silicone material can be formed, through plasma polymerization of the material, on the surface of the nozzle plate 18 and on the inner surface of the inkjet orifice 20. The number of the methyl groups that terminate the surface of the plasma polymerization film is much larger than that of the OH groups on the surface of the nozzle plate 18. The surface of the plasma polymerization film 22 is irradiated with UV rays to cut the bonding between the silicon atom and the methyl group therein, and oxygen atom is bonded to the silicon atom. Then, the plasma polymerization film 22 is exposed to air to hydroxylate its surface. Accordingly, the number of the OH groups on the surface of the plasma polymerization film 22 is much larger than that on the surface of the nozzle plate 18.

In the case where the nozzle plate 18 coated with the plasma polymerization film 22 is dipped in the alkoxysilane solution while heated, the liquid-repellent molecular film 24 is formed on the surface of the plasma polymerization film 22. Accordingly, when the nozzle plate 18 is pulled up out of the solution, the formed liquid-repellent molecular film 24 repels the alkoxysilane solution. This means that the process does not require a step of drying the processed nozzle plate 18. The molecular film 24 thus formed on the surface of the plasma polymerization film 22 by dipping the nozzle plate 18 in the alkoxysilane solution has a uniform thickness.

Since the silane coupling agent such as the long-chain RF group-having alkoxysilane is used, the film formation does not require many chemical reactions. In the case where the nozzle plate 18 is dipped in the alkoxysilane solution under heat, the time for polymerizing the alkoxysilane on the surface of the plasma polymerization film 22 can be shortened. This means that the process of the present invention does not require a long polymerization time as required in the background art.

The concentration of the alkoxysilane solution is 0.1% by weight. With the concentration, the solution can form the high-density molecular film 24. In contrast, the concentration of the solution that is used in the background art is about 0.3% by weight, and the molecular film formed from the solution has a smaller thickness and a lower density than that formed in this embodiment of the invention. This means that the method for forming the metal alkoxide film of this embodiment is cost-effective.

Since the molecular film 24 reacts with and bonds to the OH groups that terminate the surface of the plasma polymerization film 22, its density is high. As opposed to this, in the background art, the molecular film is formed on the nozzle plate where the number of OH groups that terminate the surface thereof is not large, and therefore the density of the film is low. In addition, in the molecular film 24 that is formed through polymerization in this embodiment, the silicon atoms 24*a* bond three-dimensionally and the long-chain RF groups 24*b* are complicatedly entangled with each other. Accordingly, the film is thick and has a high density. As opposed to this, in the background art, the silicon atoms in the film bond two-dimensionally to the nozzle plate. Therefore, the film is thin. In addition, since the density of the film is low, the entangled structure of the long-chain RF groups in the film is disentangled when the film is dipped in a liquid. As a result, the liquid repellency of the film does not last long. However, in the embodiment of the present invention, since the density of the film is high and the long-chain RF groups are complicatedly entangled with each other. Accordingly, even when the film is dipped in a liquid, the long-chain RF groups are not disentangled. As a result, the component of ink 26 could hardly penetrate into the molecular film 24, and the film may sustain its liquid repellency for a long period of time. Even when pigment-based ink lands thereon, the film repels it immediately. The embodiment of the invention makes it unnecessary a special technique for removing adhered ink, in wiping performed at the start of printing with an ink-jet printer. Thus, wiping can be easily performed.

FIG. 5 shows one example of an inkjet printer equipped with the inkjet printer head 10. The durability of the nozzle plate 18 processed for liquid repellency according to the invention is excellent, and those coated with an ink-repellent film of excellent organic solvent resistance are applicable to industrial use.

In this embodiment illustrated herein, the nozzle plate 18 formed of stainless steel is dipped in a solution of the silane coupling agent. As other embodiments, any other metal than stainless steel, such as nickel or iron, may also be used for the material for the nozzle plate 18, and all metal may apply to the nozzle plate 18. In addition, any other substance than metal may also be used for the material for the nozzle plate 18. For example, glass or other silicon material may be used.

For the parts of inkjet printer of which the substrate is formed of a composite material or a resinous material as described above but not stainless steel, for example, for head cap, head cleaning wiper, head cleaning wiper-holding lever, gear, platen or carriage thereof, an undercoat film that contains $SiO_2$, ZnO, NiO, $SnO_2$, $Al_2O_3$, $ZrO_2$, copper oxide, silver oxide, chromium oxide or iron oxide may also be used as well as the plasma polymerization film of silicone material mentioned hereinabove.

The undercoat film that contains $SiO_2$, ZnO, NiO, $SnO_2$, $Al_2O_3$, $ZrO_2$, copper oxide, silver oxide, chromium oxide or iron oxide may be formed in any mode of liquid film formation (e.g., coating, spraying, dipping), vapor deposition or sputtering, as well as plasma polymerization.

In the embodiment illustrated hereinabove, an piezoelectric element is used as an ink droplet-jetting element, serving to jet out the ink having been stored in the pressure room through the inkjet orifice. However, the invention includes another embodiment of disposing a heating element inside the pressure room and thereby jetting out ink droplets. The liquid-jet head of the embodiment illustrated above is an inkjet recording head, and this is for inkjet recording devices. Not limited thereto, the invention widely covers all types of liquid-jet heads and all types of liquid-jet devices. The liquid-jet heads that the invention covers include, for example, recording heads in image-recording devices such as printers; colorant-jet heads used in producing color filters for liquid-crystal displays, etc.; electrode material-jet heads used in forming electrodes in organic EL displays, FED (face-emitting displays), etc.; and biomaterial-jet heads used in producing biochips.

While the present invention has been described in detail and with reference to specific embodiments thereof, it will be apparent to one skilled in the art that various changes and modifications can be made therein without departing from the spirit and scope thereof.

The present application is based on Japanese patent application Nos. 2003-129263 (filed May 7, 2003), 2003-129261 (filed May 7, 2003) and 2004-102925 (filed Mar. 31, 2004), the contents thereof being herein incorporated by reference.

What is claimed is:

1. A member comprising a substrate, an undercoat film formed on a surface of the substrate, and a liquid-repellent film of metal alkoxide formed on a surface of the undercoat film, wherein the surface of the undercoat film is terminated with —OH groups, and the —OH groups are bonded to the metal alkoxide of the liquid-repellent film.

2. The member according to claim 1, wherein the metal alkoxide has a fluorine-containing long-chain polymer group.

3. The member according to claim 1, wherein the metal alkoxide is a metal acid salt having a liquid-repellent group.

4. The member of according to claim 1, wherein the metal alkoxide is a silane coupling agent.

5. The member according to claim 1, wherein the undercoat film comprises a plasma polymerization film of a silicone material, or contains $SiO_2$, ZnO, NiO, $SnO_2$, $Al_2O_3$, $ZrO_2$, copper oxide, silver oxide, chromium oxide or iron oxide.

6. The member according to claim 1, wherein the liquid-repellent film is formed by a process comprising:

terminating the surface of the undercoat film with —OH groups through oxidation and hydrogenation; and reacting a metal alkoxide with the —OH groups at the surface of the undercoat film.

7. The member according to claim 1, wherein the liquid-repellent film is formed by a process comprising:

terminating the surface of the undercoat film with —OH groups through irradiation with plasma or UV rays; and reacting a metal alkoxide with the —OH groups at the surface of the undercoat film.

8. The member according to claim 1, wherein the substrate comprises a metal material or a composite material.

9. The member according to claim 8, wherein the metal material is stainless steel.

10. The member according to claim 8, wherein the composite material contains silicon, sapphire or carbon.

11. The member according to claim 1, wherein the substrate comprises a resinous material.

12. The member according to claim 11, wherein the resinous material comprises at least one compound selected from the group consisting of polytetrafluoroethylene, polyethylene, polyimide, polyamidimide, polyphenylene sulfide, polyether-ether ketone, polyoxymethylene, polystyrene, acrylonitrile-butadiene-styrene, polybutylene terephthalate, polyphenylene ether, potassium titanate fiber-composite resin, polypropylene, ethylene-propylene-diene tercopolymer, olefin elastomer, urethane elastomer, chloroprene rubber, silicone rubber and butyl rubber.

13. A nozzle plate for a liquid-jet head, which comprises the member according to claim 1.

14. A liquid-jet head comprising the nozzle plate according to claim 13.

15. A liquid-jet device equipped with the liquid-jet head according to claim 14.

16. The member according to claim 1, which is a head cap, a head cleaning wiper, a head cleaning wiper-holding lever, a gear, a platen, or a carriage.

17. A liquid-jet device equipped with the member according to claim 16.

18. The member according to claim 1, wherein the liquid-repellent film is a molecular film of a polymer of metal alkoxide.

* * * * *